US012692450B2

(12) United States Patent
Shih et al.

(10) Patent No.: US 12,692,450 B2
(45) **Date of Patent: *Jul. 28, 2026**

(54) COMPOSITIONS FOR MITIGATING LOW SPEED PRE-IGNITION EVENTS

(71) Applicants: CHEVRON ORONITE COMPANY LLC, San Ramon, CA (US); CHEVRON U.S.A. INC., San Ramon, CA (US)

(72) Inventors: Jiun-Le Shih, El Sobrante, CA (US); Chung-Hao Kuo, Albany, CA (US); Charles Paul Loeper, Berkeley, CA (US)

(73) Assignees: CHEVRON ORONITE COMPANY LLC, San Ramon, CA (US); CHEVRON U.S.A. INC., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/264,117

(22) PCT Filed: Mar. 24, 2022

(86) PCT No.: PCT/IB2022/052715

§ 371 (c)(1),
(2) Date: Aug. 3, 2023

(87) PCT Pub. No.: WO2022/208250

PCT Pub. Date: Oct. 6, 2022

(65) Prior Publication Data

US 2024/0150666 A1 May 9, 2024

Related U.S. Application Data

(60) Provisional application No. 63/168,447, filed on Mar. 31, 2021.

(51) Int. Cl.

| | |
|---|---|
| ***C10L 1/222*** | (2006.01) |
| ***C10L 1/188*** | (2006.01) |
| ***C10L 1/232*** | (2006.01) |
| ***C10L 9/10*** | (2006.01) |
| ***C10M 133/08*** | (2006.01) |

(52) U.S. Cl.

CPC ..... *C10L 1/2225* (2013.01); *C10L 1/1881* (2013.01); *C10L 1/232* (2013.01); *C10L 9/10* (2013.01); *C10M 133/08* (2013.01); *C10L 2200/0423* (2013.01); *C10L 2200/0446* (2013.01); *C10M 2215/042* (2013.01)

(58) Field of Classification Search

CPC ..... C10L 1/225; C10L 1/881; C10L 1/232; C10L 9/10; C10L 2200/0423; C10L 2200/0446; C10M 2215/042; C10M 133/08

See application file for complete search history.

(56) References Cited

U.S. PATENT DOCUMENTS

| | | | | |
|---|---|---|---|---|
| 3,756,793 | A | 9/1973 | Robinson | |
| 4,191,537 | A | 3/1980 | Lewis | |
| 4,322,304 | A * | 3/1982 | Parlman | C10L 1/232 508/293 |
| 5,004,478 | A | 4/1991 | Vogel | |
| 7,351,864 | B2 | 4/2008 | Chiverton | |
| 2005/0139174 | A1 | 6/2005 | Cleveland et al. | |
| 2019/0292473 | A1 | 9/2019 | Cherpeck | |
| 2020/0017789 | A1 | 1/2020 | Cherpeck et al. | |

FOREIGN PATENT DOCUMENTS

| | | | | |
|---|---|---|---|---|
| CA | 2788326 | A1 | 8/2011 | |
| EP | 0356726 | A2 | 3/1990 | |
| EP | 0382159 | A1 | 8/1990 | |
| JP | S5736192 | A | 8/1982 | |
| RU | 2384567 | C2 * | 3/2010 | |
| WO | 2019079246 | A1 | 4/2019 | |
| WO | 2019180685 | A1 | 9/2019 | |
| WO | WO-2020099953 | A1 * | 5/2020 | C10L 1/224 |

OTHER PUBLICATIONS

International Search Report, issued on Jul. 18, 2022, during the prosecution of International Application No. PCT/IB2022/052715.
Written Opinion of the International Searching Authority, issued on Jul. 18, 2022, during the prosecution of International Application No. PCT/IB2022/052715.

* cited by examiner

*Primary Examiner* — Latosha Hines

(57) ABSTRACT

Fuel composition for preventing or reducing low speed pre-ignition events in a spark-ignited internal combustion engine is provided. The fuel composition includes a hydrocarbon fuel boiling the gasoline or diesel range and a primary additive having a structure given by

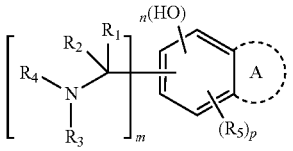

or a salt thereof. A is a ring moiety; $R_1$ and $R_2$ are independently H, $C_1$-$C_{20}$ hydrocarbyl group, carboxyl group, ether, or hydroxyl group. $R_3$ and $R_4$ are independently H, $C_1$-$C_{20}$ hydrocarbyl group, carboxyl group, ether, amino, or hydroxyl group or wherein $R_3$ and $R_4$ are part of a cyclic group. $R_5$ is $C_1$-$C_{100}$ hydrocarbyl group, carboxyl group, ether, or hydroxyl group; and p is 0 to 2, n is 1 to 3, m is 1 to 3, and p+n+m is less than 5.

8 Claims, No Drawings

COMPOSITIONS FOR MITIGATING LOW SPEED PRE-IGNITION EVENTS

TECHNICAL FIELD

This disclosure relates to compositions for preventing or mitigating low speed pre-ignition events in direct-injection engines and methods for using the same.

BACKGROUND

Turbocharged or supercharged engines (i.e., boosted internal combustion engines) may exhibit an abnormal combustion phenomenon known as stochastic pre-ignition or low-speed pre-ignition (or "LSPI"). LSPI can lead to high in-cylinder pressures and advanced combustion phasing which can cause severe knocking intensity. In worst case scenarios, LSPI can cause catastrophic engine damage. However, because LSPI events occur only sporadically and in an uncontrolled fashion, it is difficult to identify the causes for this phenomenon and to develop solutions to suppress it.

One possible explanation of LSPI is that the events are caused at least in part by auto-ignition of engine oil droplets that enter the engine combustion chamber from the piston crevice under high pressure, during periods in which the engine is operating at low speeds and compression stroke time is longest.

While there is active research and development of new engine technology, such as electronic controls and knock sensors, that attempt to address LSPI, there is also a need for fuel and/or lubricating oil compositions that can reduce or eliminate LSPI.

SUMMARY

In one aspect, there is provided a fuel composition comprising: a hydrocarbon fuel boiling in the gasoline or diesel range; and a primary additive having a structure given by

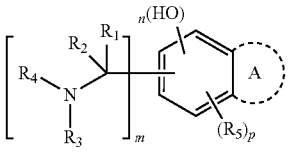

or a salt thereof; wherein A is a ring moiety; wherein $R_1$ and $R_2$ are independently H, $C_1$-$C_{20}$ hydrocarbyl group, carboxyl group, ether, or hydroxyl group; wherein $R_3$ and $R_4$ are independently H, $C_1$-$C_{20}$ hydrocarbyl group, carboxyl group, ether, amino, or hydroxyl group or wherein $R_3$ and $R_4$ are part of a cyclic group; $R_5$ is $C_1$-$C_{20}$ hydrocarbyl group, carboxyl group, ether, or hydroxyl group; and wherein p is 0 to 2, n is 1 to 3, m is 1 to 3, and p+n+m is less than 5.

In another aspect, there is provided a method for preventing or reducing low speed pre-ignition events in a spark-ignited internal combustion engine, the method comprising: supplying to the engine a fuel composition comprising: a hydrocarbon fuel boiling in the gasoline or diesel range; and a primary additive having a structure given by

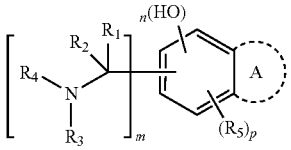

or a salt thereof; wherein A is a ring moiety; wherein $R_1$ and $R_2$ are independently H, $C_1$-$C_{20}$ hydrocarbyl group, carboxyl group, ether, or hydroxyl group; wherein $R_3$ and $R_4$ are independently H, $C_1$-$C_{20}$ hydrocarbyl group, carboxyl group, ether, amino, or hydroxyl group or wherein $R_3$ and $R_4$ are part of a cyclic group; $R_5$ is $C_1$-$C_{100}$ hydrocarbyl group, carboxyl group, ether, or hydroxyl group; and wherein p is 0 to 2, n is 1 to 3, m is 1 to 3, and p+n+m is less than 5.

In yet another aspect, there is provided a lubricating oil composition comprising: a base oil of lubricating viscosity; and a primary additive having a structure given by

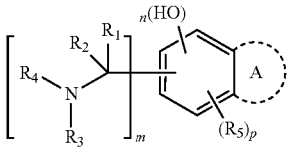

or a salt thereof; wherein A is a ring moiety; wherein $R_1$ and $R_2$ are independently H, $C_1$-$C_{20}$ hydrocarbyl group, carboxyl group, ether, or hydroxyl group; wherein $R_3$ and $R_4$ are independently H, $C_1$-$C_{20}$ hydrocarbyl group, carboxyl group, ether, amino, or hydroxyl group or wherein $R_3$ and $R_4$ are part of a cyclic group; $R_5$ is $C_1$-$C_{20}$ hydrocarbyl group, carboxyl group, ether, or hydroxyl group; and wherein p is 0 to 2, n is 1 to 3, m is 1 to 3, and p+n+m is less than 5.

DETAILED DESCRIPTION

Introduction

In this specification, the following words and expressions, if and when used, have the meanings ascribed below.

"Gasoline" or "gasoline boiling range components" refers to a composition containing at least predominantly $C_4$-$C_{12}$ hydrocarbons. In one embodiment, gasoline or gasoline boiling range components is further defined to refer to a composition containing at least predominantly $C_4$-$C_{12}$ hydrocarbons and further having a boiling range of from about 100° F. (37.8° C.) to about 400° F. (204° C.). In an alternative embodiment, gasoline or gasoline boiling range components is defined to refer to a composition containing at least predominantly $C_4$-$C_{12}$ hydrocarbons, having a boiling range of from about 100° F. (37.8° C.) to about 400° F. (204° C.), and further defined to meet ASTM D4814.

The term "oil soluble" means that for a given additive, the amount needed to provide the desired level of activity or performance can be incorporated by being dissolved, dispersed or suspended in an oil of lubricating viscosity. Usually, this means that at least 0.001% by weight of the additive can be incorporated in a lubricating oil composition. The term "fuel soluble" is an analogous expression for additives dissolved, dispersed or suspended in fuel.

A "minor amount" means less than 50 wt % of a composition, expressed in respect of the stated additive and in respect of the total weight of the composition, reckoned as active ingredient of the additive.

An "engine" or a "combustion engine" is a heat engine where the combustion of fuel occurs in a combustion chamber. An "internal combustion engine" is a heat engine where the combustion of fuel occurs in a confined space ("combustion chamber"). A "spark ignition engine" is a heat engine where the combustion is ignited by a spark, usually from a spark plug. This is contrast to a "compression-ignition engine," typically a diesel engine, where the heat generated from compression together with injection of fuel is sufficient to initiate combustion without an external spark.

Low Speed Pre-Ignition (LSPI)

Low Speed Pre-Ignition (LSPI) is most or more likely to occur in direct-injected, boosted (turbocharged or supercharged), spark-ignited (gasoline) internal combustion engines that, in operation, generate a brake mean effective pressure level of greater than 1000 kPa (10 bar) at engine speeds of from 1500 to 2500 rotations per minute (rpm), such as at engine speeds of from 1500 to 2000 rpm. "Brake mean effective pressure" (BMEP) is defined as the work accomplished during on engine cycle, divided by the engine swept volume, the engine torque normalized by engine displacement. The word "brake" denotes the actual torque or power available at the engine flywheel, as measured on a dynamometer. Thus, BMEP is a measure of the useful energy output of the engine.

It has now been found that the fuel additives or lubricating oil additives of this disclosure which are particularly useful in high pressure spark-ignited internal combustion engines and, when used in the high pressure spark-ignited internal combustion engines, will prevent or minimize engine knocking and pre-ignition problems.

Phenolic Amines

The fuel or lubricant additives of the present invention includes phenolic amine compositions that have the following generalized Structure 1 or a salt thereof:

Structure 1

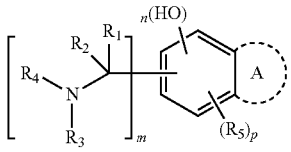

For Structure 1, n is 1 to 3, p is 0 to 2, m is 1 to 3, wherein p+m+n<5.

Moiety A is a ring such as an aromatic ring or a heterocyclic ring.

Each $R_1$ is independently a hydrogen, $C_1$-$C_{20}$ hydrocarbyl group, carboxyl group (e.g., carboxylic acid, ester, amide, ketone, etc.), ether, or hydroxyl group.

Each $R_2$ is independently a hydrogen, $C_1$-$C_{20}$ hydrocarbyl group, carboxyl group (e.g., carboxylic acid, ester, amide, ketone, etc.), ether, or hydroxyl group.

Each $R_3$ is independently a hydrogen, $C_1$-$C_{20}$ hydrocarbyl group, carboxyl group (e.g., carboxylic acid, ester, amide, ketone, etc.), ether, amino, or hydroxyl group.

Each $R_4$ is independently a hydrogen, $C_1$-$C_{20}$ hydrocarbyl group, carboxyl group (e.g., carboxylic acid, ester, amide, ketone, etc.), ether, amino, or hydroxyl group.

In some embodiments, $R_3$ and $R_4$ may form a cyclic group. In some embodiments, the cyclic group includes one or more nitrogens or one or more oxygens.

$R_5$ is $C_1$-$C_{100}$ hydrocarbyl group, carboxyl group (e.g., carboxylic acid, ester, amide, ketone, etc.), ether, or hydroxyl group.

According to an embodiment, $R_1$ and $R_2$ are both hydrogen. In some embodiments, at least one of $R_3$ and $R_4$ is a methyl group. In some embodiments, $R_5$ is $C_1$-$C_4$ hydrocarbyl group.

Suitable examples of phenolic amines include 1,3-bis((dimethylamino)methyl)naphthalen-2-ol (Structure 2A), 2,4-bis(morpholinomethyl)naphthalene-1,3-diol (Structure 2B), 5,7-Bis((dimethylamino)methyl)quinolin-8-ol (Structure 2C), 4,6-bis((dimethylamino)methyl)-1H-benzo[d]imidazol-5-ol (Structure 2D), and 4-((dihexylamino)methyl)-1-phenyl-2-(phenylamino)-1H-benzo[d]imidazol-5-ol (Structure 2E).

Structure 2A

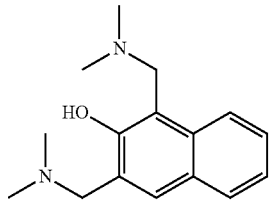

Structure 2B

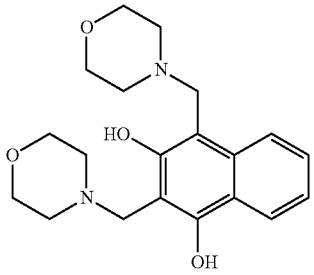

Structure 2C

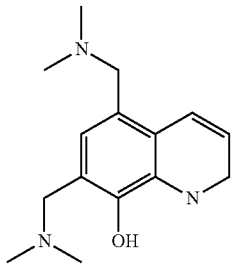

Structure 2D

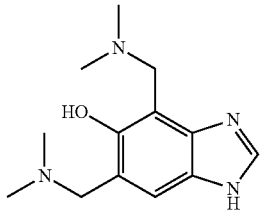

-continued

Structure 2E

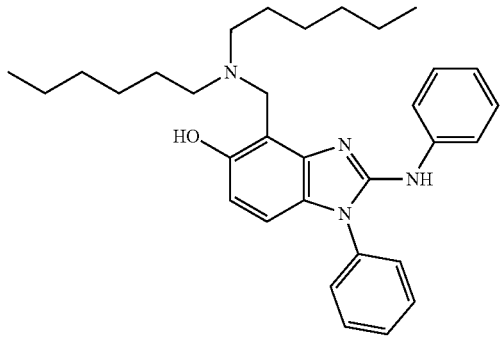

The phenolic amine compositions of the present invention may be obtained commercially or synthesized by any known method. For example, one or more phenolic amine additives of the present invention may be synthesized via a Mannich reaction which typically involve amino alkylation of a carbonyl function group by an aldehyde. A detailed description of Mannich reaction can be found in, for example, U.S. Pat. No. 7,351,864, which is hereby incorporated by reference.

In some embodiments, the phenolic amine may be present in salt form. The salt of the phenolic amine is typically the protonated form (i.e., ammonium). When the phenolic amine additive is present in salt form, it can coordinate with one or more secondary LSPI-reducing additives. The interaction of the phenolic amine and secondary additive is synergistic and can provide greater than expected LSPI reduction.

In some embodiments, the phenolic amine may interact synergistically with one or more secondary additives, wherein the phenolic amine and the one or more secondary additive are in non-salt (neutral) form. Suitable secondary additives include acids (aliphatic acids, unsaturated acids, alkylaromatic acids, aromatic acids, hydroxy acids, amino acids, salicylic acids), phenols, 1,3 dicarbonyls (e.g., 1,3 diketone, 1,3 ketoester), hydroxamides, antioxidants (e.g., mono-carboxylic acid, dicarboxylic acid), amidines, guanidines, and triazines.

The following are descriptions of secondary additives that can be utilized as fuel or lubricating additives to reduce LSPI activity. A secondary LSPI-reducing additive, a substituted secondary LSPI-reducing additive, or a derivative thereof will be used in their salt or neutral form and in combination with a primary additive in its salt or neutral form to reduce LSPI activity. For example, phenolic amine and aliphatic acid (secondary additive) can be combined and utilized as an LSPI additive.

Acid Additives

Aliphatic Acid

Aliphatic acids are non-aromatic carboxylic acids. Suitable aliphatic acids include mono-carboxylic acids having the following structure Structure 3

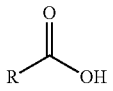

wherein R is an aliphatic group having between 2 to 20 carbon atoms. The aliphatic group may be linear or branched and may contain heteroatoms.

Suitable aliphatic acids include hexanoic acid (Structure 3A), heptanoic acid (Structure 3B), octanoic acid (Structure 3C), nonanoic acid (Structure 3D), decanoic acid (Structure 3E), undecanoic acid, lauric acid, myristic acid, palmitic acid, stearic acid, arachidic acid ($C_{20}$), behenic acid ($C_{22}$), 2-ethylbutyric acid (Structure 3F), 3,3-dimethylbutyric acid, 2-methylpentanoic acid ($C_6$), 2-methylhexanoic acid ($C_7$), 4-methylhexanoic acid ($C_7$), 5-methylhexanoic acid ($C_7$), 2,2-dimethylpentanoic acid ($C_7$), 2-propylpentanoic acid ($C_8$), 2-ethylhexanoic acid (Structure 3G), 2-methylheptanoic acid ($C_8$), isooctanoic acid ($C_8$), 3,5,5-trimethylhexanoic acid ($C_9$), 4-methyloctanoic acid ($C_9$), 4-methylnonanoic acid, ($C_{10}$), isodecanoic acid ($C_{10}$), 2-butyloctanoic acid ($C_{12}$), isotridecanoic acid ($C_{13}$), 2-hexyldecanoic acid ($C_{16}$), isopalmitic acid ($C_{16}$), isostearic acid (Structure 3H), 3-cyclohexylpropionic acid, 4-cyclohexylbutyric acid (Structure 31), and cyclohexanepentanoic acid. Representative structures are shown below.

Structure 3A

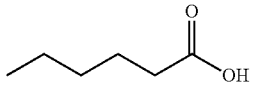

Structure 3B

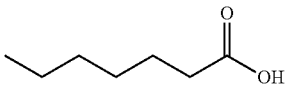

Structure 3C

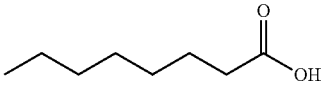

Structure 3D

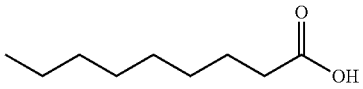

Structure 3E

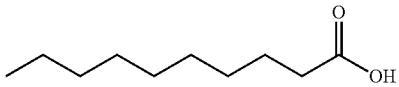

Structure 3F

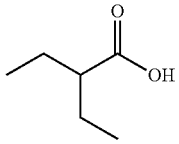

Structure 3G

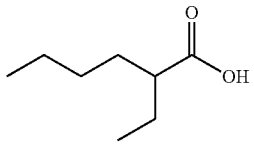

Structure 3H

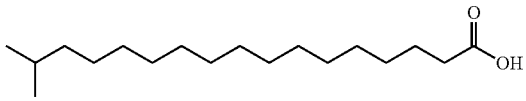

Structure 3I

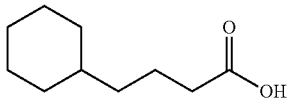

-continued

Structure 3J

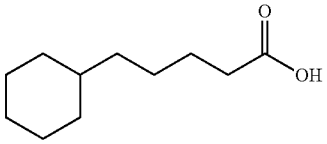

Unsaturated Acid

Suitable unsaturated acids include any organic acids that contain double or triple carbon-carbon bond. Representative unsaturated acids include maleic acid (Structure 4A), fumaric acid (Structure 4B), as well as unsaturated fatty acids such as palmitoleic acid (Structure 4C) and oleic acid (Structure 4D). Representative structures are shown below.

Structure 4A

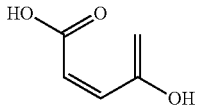

Structure 4B

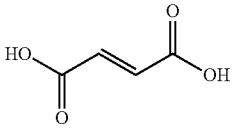

Structure 4C

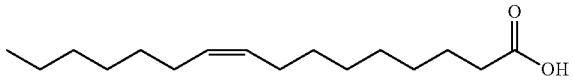

Structure 4D

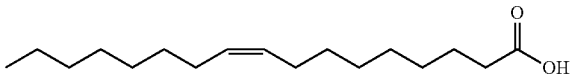

Alkylaromatic Acid

Suitable alkylaromatic acids include both mono-carboxylic acids and dicarboxylic acids. The alkyl carboxylic acid may have 6 or more carbon atoms (e.g., 6 to 24 carbon atoms, 6 to 20 carbon atoms, 8 to 24 carbon atoms, 8 to 20 carbon atoms, or even 8 to 18 carbon atoms). The alkyl moiety may be optionally substituted with one or more substituents such as hydroxy, alkoxy and carbonyl (e.g., aldehydic or ketonic) groups. Suitable examples of alkylaromatic acid include methylbenzoic acid (Structure 5A) and ethylbenzoic acid (Structure 5B). Representative structures are shown below.

Structure 5A

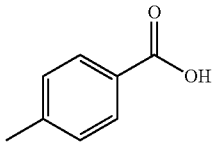

Structure 5B

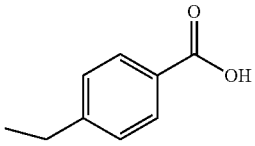

-continued

Structure 5C

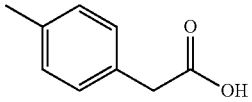

Aromatic Acid

Suitable aromatic acids include both mono-carboxylic acids and dicarboxylic acids. The alkyl carboxylic acid may have 6 or more carbon atoms (e.g., 6 to 24 carbon atoms, 6 to 20 carbon atoms, 8 to 24 carbon atoms, 8 to 20 carbon atoms, or even 8 to 18 carbon atoms). The alkyl moiety may be optionally substituted with one or more substituents such as hydroxy, alkoxy and carbonyl (e.g., aldehydic or ketonic) groups. Suitable aromatic acids include benzoic acid (Structure 6A), hydroxybenzoic acid (Structure 6B), and tetralin carboxylic acid (Structure 6C). Representative structures are shown below.

Structure 6A

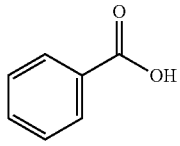

Structure 6B

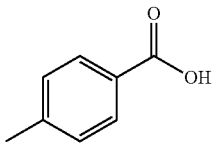

Structure 6AC

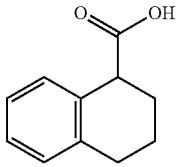

Hydroxy Acid

Suitable hydroxy acids include those that can be represented by the following general formula:

Structure 7

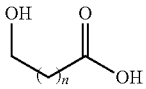

wherein n=1 to 3. Suitable examples of hydroxy acid include glycolic acid (Structure 7A), lactic acid (Structure 7B), malic acid (Structure 7C), tartaric acid (Structure 7D), and citric acid (Structure 7E). Representative structures are shown below.

Structure 7A

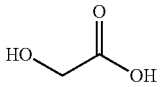

-continued

Structure 7B

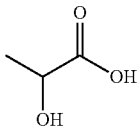

Structure 7C

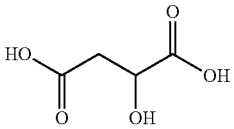

Structure 7D

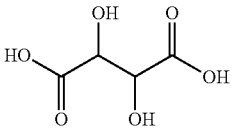

Structure 7E

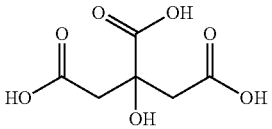

Phenol Additives

Phenol

Suitable phenols include, thymol (Structure 8A), eugenol (Structure 8B), hydroquinone (Structure 8C), resorcinol (Structure 8D), p-cresol (Structure 8E), 2-methylquinolin-8-ol ("8-hydroxyquinaldine") (Structure 8G), phloroglucinol (Structure 8H), m-cresol (Structure 81), o-cresol (Structure 8J), catechol (Structure 8K), and 8-quinolinol (Structure 8L). Representative structures are shown below.

Structure 8A

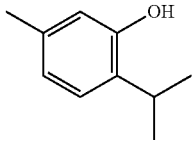

Structure 8B

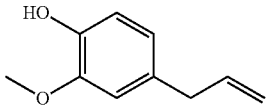

Structure 8C

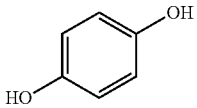

Structure 8D

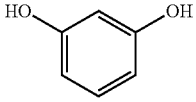

Structure 8E

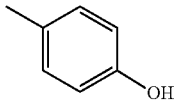

Structure 8F

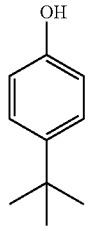

Structure 8G

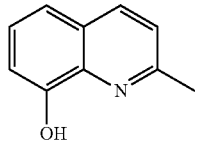

Structure 8H

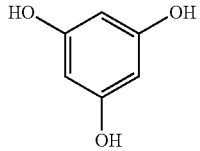

Structure 8I

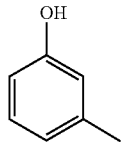

Structure 8J

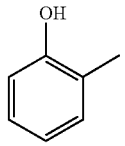

Structure 8K

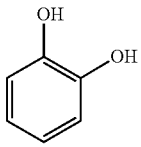

Structure 8L

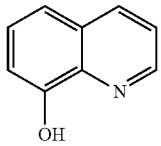

1,3 Dicarbonyl Additives 1,3 Diketone

Suitable examples of 1,3 diketone compounds include acetylacetone (Structure 9A), and curcumin (Structure 9B). Representative structures are shown below.

Structure 9A

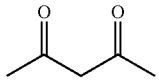

-continued

Structure 9B

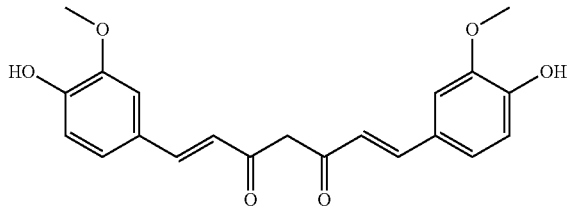

1,3 Ketoester

Suitable 1,3 ketoesters are shown below.

Structure 10A

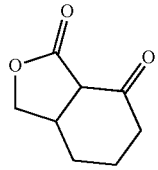

Structure 10B

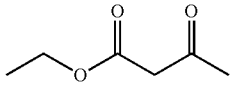

Hydroxamide Additives

A hydroxamide is a hydroxy derivative of an amide. Useful hydroxamides include those that can be represented by the following general formula:

Structure 11

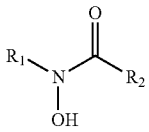

wherein $R_1$ and $R_2$ are each independently selected from hydrogen or $C_1$-$C_{20}$ (e.g., $C_3$-$C_{12}$) alkyl group. Suitable hydroxamide includes hydroxy methylacetamide (Formula 21A). Other suitable structures are shown below.

Structure 11A

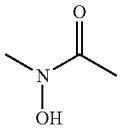

Structure 11B

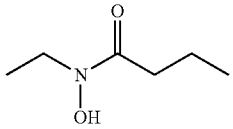

Structure 11C

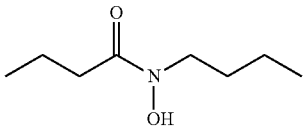

Antioxidant Additives

Suitable antioxidants include both mono-carboxylic acids and dicarboxylic acids. The alkyl carboxylic acid may have 6 or more carbon atoms (e.g., 6 to 24 carbon atoms, 6 to 20 carbon atoms, 8 to 24 carbon atoms, 8 to 20 carbon atoms, or even 8 to 18 carbon atoms). The alkyl moiety may be optionally substituted with one or more substituents such as hydroxy, alkoxy and carbonyl (e.g., aldehydic or ketonic) groups. Suitable antioxidants include the following.

Structure 12

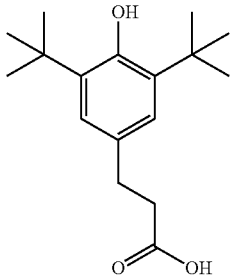

Salicylic Acid Additives

Salicylic Acid

Suitable salicylic acids include 2-hydroxy-5-(tetracosa-1,3,5,7,9,11,13,15,17,19,21,23-dodecayn-1-yl) benzoic acid-dihydrogen (Structure 13E). Suitable salicylic acids are shown below.

Structure 13A

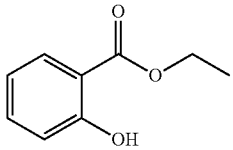

Structure 13B

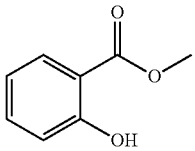

Structure 13C

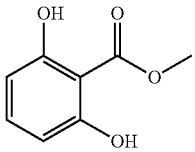

Structure 13D

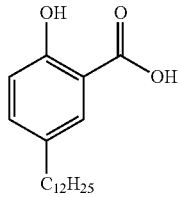

-continued

Structure 13E

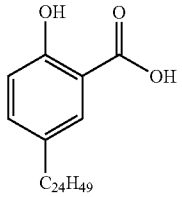

Amidine

Useful amidines include those that can be represented by the following general formula:

Structure 14A

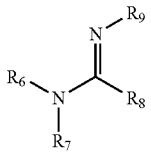

wherein $R_6$, $R_7$, $R_8$ and $R_9$ are each independently selected from hydrogen, monovalent organic groups, monovalent heterorganic groups (e.g., comprising nitrogen, oxygen, sulfur or phosphorus, in the form of groups or moieties that are bonded through a carbon atom and that do not contain acid functionality such as carboxylic or sulfonic), and combinations thereof; and wherein any two or more of $R_6$, $R_7$, $R_8$ and $R_9$ optionally can be bonded together to form a cyclic structure (e.g., a five-, six, or seven-membered ring). The cyclic structures may be aromatic or non-aromatic, as well as vary from being fully saturated to fully unsaturated. The organic and heterorganic groups may have from 1 to 10 carbon atoms (e.g., 1 to 6 carbon atoms).

Suitable amidines include 1,4,5,6-tetrahydropyrimidine (Structure 14A), 1,2-dimethyl-1,4,5,6-tetrahydropyrimidine (Structure 14B), 1,2-diethyl-1,4,5,6-tetrahydropyrimidine (Structure 14C), 1,5-diazabicyclo[4.3.0]non-5-ene (DBN; Structure 14D), 1,8-diazabicyclo[5.4.0]-undeca-7-ene (DBU; Structure 14E), benzamidine (Structure 14F), benzimidazole (Structure 14G) and 2-phenyl-1H-benzo[d]imidazole (Structure 14M). Representative structures are shown below.

Structure 14A

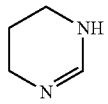

Structure 14B

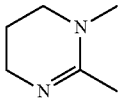

Structure 14C

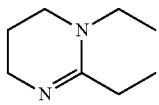

Structure 14D

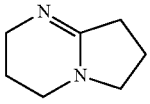

-continued

Structure 14E

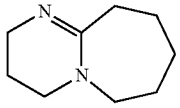

Structure 14F

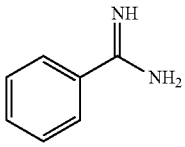

Structure 14G

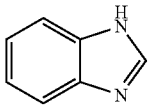

Structure 14H

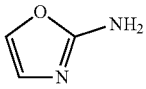

Structure 14I

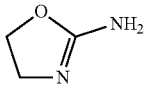

Structure 14J

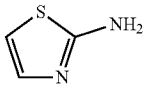

Structure 14K

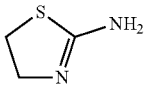

Structure 14L

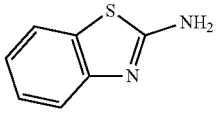

Structure 14M

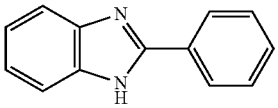

Guanidine Additives

Representative examples of suitable guanidines include 1,1,3,3-tetramethylguanidine (Structure 15A), 2-tert-butyl-1,1,3,3-tetramethylguanidine (Structure 15B), phenylguanidine (Structure 15C), 7-methyl-1,5,7-triazabicyclo[4.4.0]dec-5-ene (Structure 15D), 1,5,7-triazabicyclo[4.4.0]dec-5-ene (Structure 15E), 1,3-diphenylguanidine (Structure 15F), 1,3-di-o-tolylguanidine (Structure 15G), 1,2,3-triphenylguanidine (Structure 15H), N-benzylguanidine (Structure 151), N-cyclohexylguanidine (Structure 15J), aminoguanidine (Structure 15K), 1,3-diaminoguanidine (Structure 15L), N,N',N"-triaminoguanidine (Structure 15M), and 1-phenylbiguanide (Structure 15N).

Structure 15A

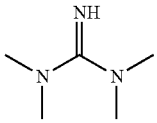

-continued

Structure 15B

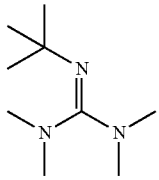

Structure 15C

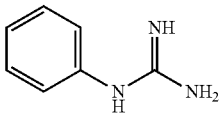

Structure 15D

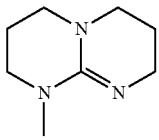

Structure 15E

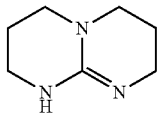

Structure 15F

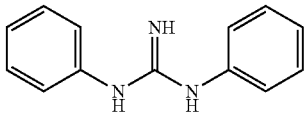

Structure 15G

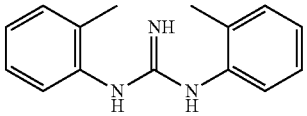

Structure 15H

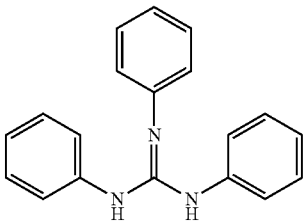

Structure 15I

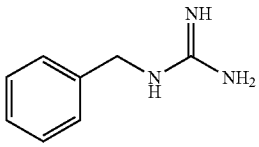

Structure 15J

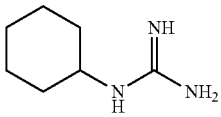

Structure 15K

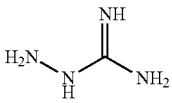

Structure 15L

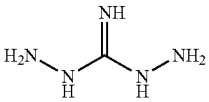

-continued

Structure 15M

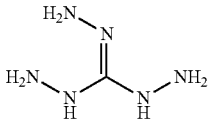

Structure 15N

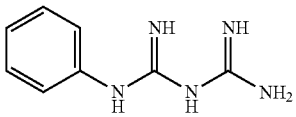

Triazine Additives

Suitable triazines include $N^2,N^4,N^6$-triphenyl-1,3,5-triazine-2,4,6-triamine (Structure 16A), 2,4,6-trimorpholino-1,3,5-triazine (Structure 16B), 2,4,6-tris(4-methyl piperazin-1-yl)-1,3,5-triazine (Structure 16C), and $N^2,N^2,N^4,N^4,N^6,N^6$-hexabutyl-1,3,5-triazine-2,4,6-triamine (Structure 16D).

Structure 16A

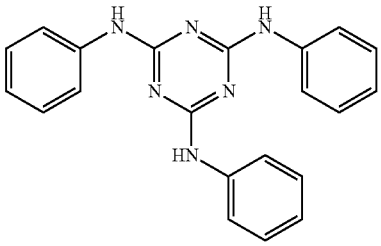

Structure 16B

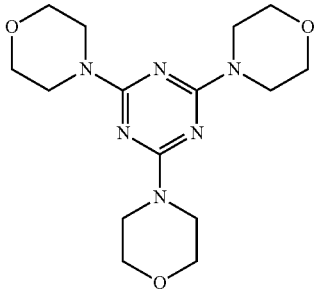

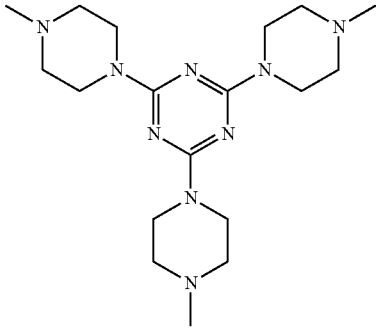

-continued

Structure 16C

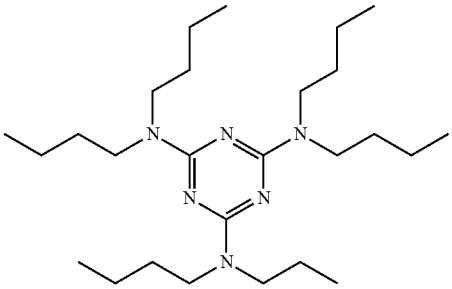

Amino Acid

Useful amino acids include those that can be represented by the following general formula:

Structure 17

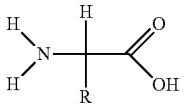

wherein R is an "aliphatic" or "aromatic" side chain. Amino acid side chains can be broadly classified as aromatic or aliphatic. An aromatic side chain includes an aromatic ring. Examples of amino acids with aromatic side chains include for example, histidine (Structure 17A), phenylalanine (Structure 17B), tyrosine (Structure 17C), tryptophan (Structure 17D) and the like. Non-aromatic side chains are broadly grouped as "aliphatic" and include, for example, alanine (Structure 17E), glycine (Structure 17F), cysteine (Structure 17G), and the like.

The amino acid(s) can be natural and/or non-natural α-amino acids. Natural amino acids are those encoded by the genetic code, as well as amino acids derived therefrom. These include, for example, hydroxyproline (Structure 17H), γ-carboxyglutamate (Structure 171), and citrulline (Structure 17J). In this specification, the term "amino acid" also includes amino acid analogs and mimetics. Analogs are compounds having the same general structure of a natural amino acid, except that the R group is not one found among the natural amino acids.

Representative examples of analogs of naturally occurring amino acids include homoserine (Structure 17K), norleucine (Structure 17L), homoproline (Structure 17M) and proline (Structure 17N). An amino acid mimetic is a compound that has a structure different from the general chemical structure of an α-amino acid but functions in a manner similar to one. The amino acid may be an L- or D-amino acid. Suitable structures are shown below.

Structure 17A

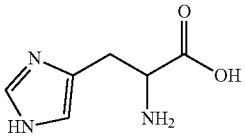

-continued

Structure 17B

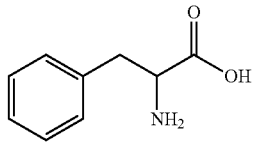

Structure 17C

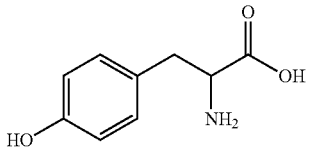

Structure 17D

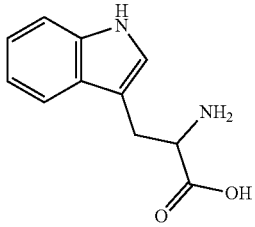

Structure 17E

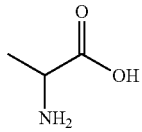

Structure 17F

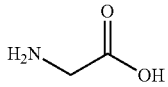

Structure 17G

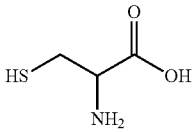

Structure 17H

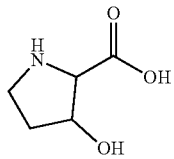

Structure 17I

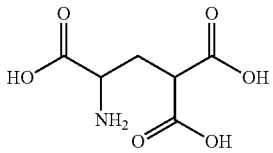

Structure 17J

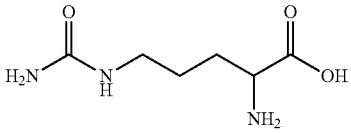

Structure 17K

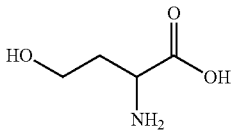

-continued

Structure 17L

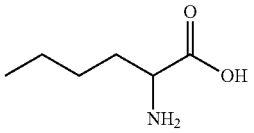

Structure 17M

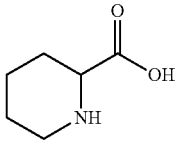

Structure 17N

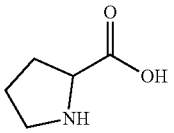

Salts

The salts of this disclosure may be prepared by conventional means, for example, by mixing the primary additive with a suitable secondary additive in an aprotic solvent. The order in which one additive is added to the other is not important. The primary additive and secondary additive are usually mixed together in an approximately equimolar ratio. An excess of the primary or secondary additive component may be used. For example, the molar ratio of base relative to the alkyl carboxylic acid may be about 1.05:1 to 2:1 (e.g., 1.1:1 to 1.5:1).

Fuel Compositions

The compounds of the present disclosure may be useful as additives in hydrocarbon fuels to prevent or reduce engine knock or pre-ignition events in spark-ignited internal combustion engines.

The concentration of the compounds of the present disclosure in hydrocarbon fuel may range from 25 to 5000 parts per million (ppm) by weight (e.g., 50 to 1000 ppm).

The compounds of the present disclosure may be formulated as a concentrate using an inert stable oleophilic (i.e., soluble in hydrocarbon fuel) organic solvent boiling in a range of 65° C. to 205° C. An aliphatic or an aromatic hydrocarbon solvent may be used, such as benzene, toluene, xylene, or higher-boiling aromatics or aromatic thinners. Aliphatic alcohols containing 2 to 8 carbon atoms, such as ethanol, isopropanol, methyl isobutyl carbinol, n-butanol and the like, in combination with the hydrocarbon solvents are also suitable for use with the present additives. In the concentrate, the amount of the additive may range from 10 to 70 wt % (e.g., 20 to 40 wt %).

In gasoline fuels, other well-known additives can be employed including oxygenates (e.g., ethanol, methyl tert-butyl ether), other anti-knock agents, and detergents/dispersants (e.g., hydrocarbyl amines, hydrocarbyl poly(oxyalkylene) amines, succinimides, Mannich reaction products, aromatic esters of polyalkylphenoxyalkanols, or polyalkylphenoxyaminoalkanes). Additionally, friction modifiers, antioxidants, metal deactivators and demulsifiers may be present.

In diesel fuels, other well-known additives can be employed, such as pour point depressants, flow improvers, cetane improvers, and the like.

A fuel-soluble, non-volatile carrier fluid or oil may also be used with compounds of this disclosure. The carrier fluid is a chemically inert hydrocarbon-soluble liquid vehicle which substantially increases the non-volatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described in U.S. Pat. Nos. 3,756,793; 4,191,537; and 5,004,478; and in European Patent Appl. Pub. Nos. 356,726 and 382,159.

The carrier fluids may be employed in amounts ranging from 35 to 5000 ppm by weight of the hydrocarbon fuel (e.g., 50 to 3000 ppm of the fuel). When employed in a fuel concentrate, carrier fluids may be present in amounts ranging from 20 to 60 wt % (e.g., 30 to 50 wt %).

Lubricating Oil Compositions

The compounds of the present disclosure may be useful as additives in lubricating oils to prevent or reduce engine knock or pre-ignition events in spark-ignited internal combustion engines.

The concentration of the compounds of the present disclosure in the lubricating oil composition may range from 0.01 to 15 wt % (e.g., 0.5 to 5 wt %), based on the total weight of the lubricating oil composition.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group Ill, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.01 to about 10 wt %.

The following illustrative examples are intended to be non-limiting.

Example

Engine Test

A 4-GM 2.0-L Ecotec 4-cylinder gasoline turbocharged direct-injection engine was used for LSPI testing. In this setup, each cylinder was outfitted with a pressure transducer to monitor in-cylinder pressure.

A six-segment test procedure was used to determine the number of LSPI events across all four cylinders at an engine speed of 2000 rpm at a load of 290 N-m. Each segment was 28 minutes, separated by an idle period at low engine speed and load. LSPI frequency during segments two through six are reported for comparison; and the first segment is not considered due to engine oil conditioning. To account for LSPI activity during transient conditions, the beginning of each segment is filtered, or removed, to allow for comparisons of activity during steady state operation only. This truncation typically results in the removal of approximately 4,000 cycles per cylinder per segment leading to approximately 100,000 measured cycles per segment (or 25,000 cycles per cylinder).

During testing, both combustion pressure and phasing were monitored for each cylinder. An LSPI event occurred when two criteria were achieved: 1) peak cylinder pressure exceeded five standard deviations from the mean peak pressure; and 2) combustion phasing (CA5, or the crank angle at which 5% heat release occurs) advanced more than five standard deviations from the mean CA5. Unadditized 49-state premium unleaded gasoline was used to establish baseline LSPI activity before and after an LSPI-mitigating additive test. Base fuel information: FR62180-49 state unadditized PUL fuel. The engine oil used during testing met ILSAC GF-5 and API SN specifications.

LSPI frequency is reported as the average number of events per cylinder over one million cycles. The reported change in LSPI frequency is the percentage difference with respect to the pre- and post-baseline runs.

The treat rate in the examples shown below is 1000 ppmw (1:1 equivalent) additives in fuel, wherein the primary additive is varied and the secondary additive is DBU.

LSPI events reduction results are shown in Table 1 below.

TABLE 1

| Additives | LSPI events reduction (%) |
|---|---|
| 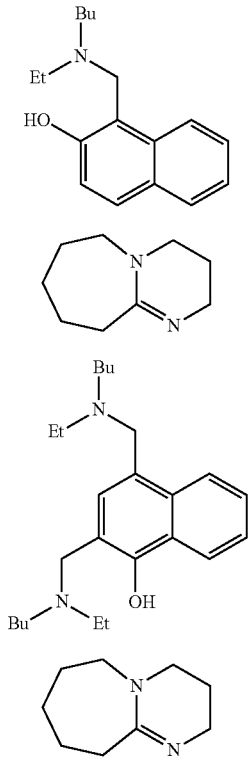 | 92% |
|  | 80.9% |

TABLE 1-continued

| Additives | LSPI events reduction (%) |
|---|---|
| 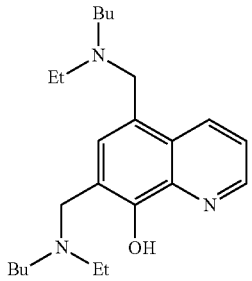 | 83.2% |
| 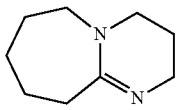 | |
| 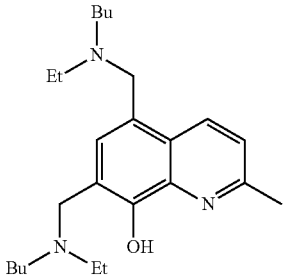 | 80% |
| 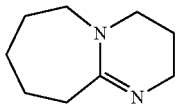 | |
| 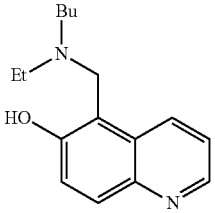 | 92.8% |

TABLE 1-continued

| Additives | LSPI events reduction (%) |
|---|---|
| 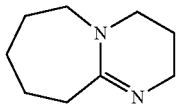 | |

The invention claimed is:

1. A method for preventing or reducing low speed pre-ignition events in a spark-ignited internal combustion engine, the method comprising:

supplying to the engine a fuel composition comprising:

a hydrocarbon fuel boiling in gasoline or diesel range; and a primary additive having a structure given by

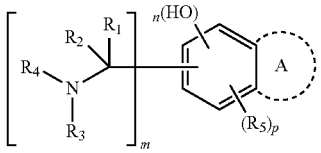

or a salt thereof;

wherein A is a ring moiety;

wherein $R_1$ and $R_2$ are independently H, $C_1$-$C_{20}$ hydrocarbyl group, carboxyl group, ether, or hydroxyl group;

wherein $R_3$ and $R_4$ are independently H, $C_1$-$C_{20}$ hydrocarbyl group, carboxyl group, ether, amino, or hydroxyl group or wherein $R_3$ and $R_4$ are part of a cyclic group;

$R_5$ is $C_1$-$C_{100}$ hydrocarbyl group, carboxyl group, ether, or hydroxyl group; and wherein p is 0 to 2, n is 1 to 3, m is 1 to 3, and p+n+m is less than 5.

2. The method of claim 1, wherein the composition further comprising a second additive or a salt thereof, wherein the second additive is an acid, phenol, 1, 3 dicarbonyl, hydroxyamide, antioxidant, salicylate, amidine or guanidine.

3. The method of claim 1, wherein the carboxyl group is carboxylic acid ester, amide, or ketone.

4. The method of claim 1, wherein A is an aromatic ring or a heterocyclic ring.

5. The method of claim 1, wherein the cyclic group includes one or more nitrogens or one or more oxygens.

6. The method of claim 2, wherein the secondary additive is 2-ethylhexanoic acid, or 1,8-diazabicyclo[5.4.0]-undeca-7-ene.

7. The method of claim 1, wherein $R_1$ and $R_2$ are both hydrogen.

8. The method of claim 1, wherein at least one of $R_3$ and $R_4$ is an ethyl or butyl group.

* * * * *